US009751313B2

(12) United States Patent
Obertegger

(10) Patent No.: US 9,751,313 B2
(45) Date of Patent: Sep. 5, 2017

(54) PRINT HEAD FOR AN INK JET PRINTER

(71) Applicant: DURST PHOTOTECHNIK—A.G., Brixen (IT)

(72) Inventor: Franz Obertegger, Brixen (IT)

(73) Assignee: DURST PHOTOTECHNIK—A.G., Brixen (IT)

( * ) Notice: Subject to any disclaimer, the term of this patent is extended or adjusted under 35 U.S.C. 154(b) by 0 days.

(21) Appl. No.: 14/837,378

(22) Filed: Aug. 27, 2015

(65) Prior Publication Data

US 2015/0360472 A1 Dec. 17, 2015

Related U.S. Application Data

(62) Division of application No. 14/233,933, filed as application No. PCT/EP2012/063582 on Jul. 11, 2012, now abandoned.

(30) Foreign Application Priority Data

Jul. 22, 2011 (AT) ..... A 1081/2011

(51) Int. Cl.
*B41J 2/055* (2006.01)
*B41J 2/175* (2006.01)
(Continued)

(52) U.S. Cl.
CPC ..... *B41J 2/175* (2013.01); *B41J 2/04* (2013.01); *B41J 2/045* (2013.01); *B41J 2/14* (2013.01);
(Continued)

(58) Field of Classification Search
USPC ..... 347/17, 54; 137/883
See application file for complete search history.

(56) References Cited

U.S. PATENT DOCUMENTS 4,576,111 A 3/1986 Slomianny
4,875,058 A 10/1989 Vonasek
(Continued)

FOREIGN PATENT DOCUMENTS

EP 0 445 137 B1 5/1993
EP 0 787 587 A1 8/1997
(Continued)

OTHER PUBLICATIONS

International Search Report of PCT/EP2012/063582, mailed Oct. 24, 2012.

*Primary Examiner* — Lam Nguyen
(74) *Attorney, Agent, or Firm* — Collard & Roe, P.C.

(57) ABSTRACT

A print head for an ink jet printer includes at least one ink supply channel and at least one nozzle having a nozzle channel and an inflow opening, and ink can be pressed from the ink supply channel through the inflow opening into the nozzle channel and ejected therefrom, wherein the nozzle is arranged in a stationary manner on a side wall of the ink supply channel and in the ink supply channel a ram is provided, which can be moved back and forth between a reversal point that has a minimal distance from the inflow opening of the nozzle and a reversal point that has a maximal distance from the inflow opening of the nozzle, wherein a first limiting device limits the movement of a ram end face to a movement between the reversal points; and a second external device is provided for applying a negative pressure relative to the ambient air pressure to the ink in the ink supply channel.

24 Claims, 3 Drawing Sheets

(51) Int. Cl.
*B41J 2/04* (2006.01)
*B41J 2/14* (2006.01)
*B41J 2/045* (2006.01)

(52) U.S. Cl.
CPC ..... *B41J 2002/041* (2013.01); *B41J 2202/05* (2013.01)

(56) References Cited

U.S. PATENT DOCUMENTS

| | | | | |
|---|---|---|---|---|
| 5,602,575 | A | 2/1997 | Pauly | |
| 6,027,205 | A | 2/2000 | Herbert | |
| 2008/0231650 | A1* | 9/2008 | Kojima | B41J 2/055 347/17 |
| 2010/0294793 | A1 | 11/2010 | Brown et al. | |
| 2010/0302325 | A1 | 12/2010 | Shin et al. | |

FOREIGN PATENT DOCUMENTS

| | | | |
|---|---|---|---|
| GB | 2 134 452 | A | 8/1984 |
| JP | H01-229640 | A | 9/1989 |
| JP | H02-102053 | A | 4/1990 |
| JP | H03-281252 | A | 12/1991 |
| JP | H06-255108 | A | 9/1994 |
| JP | H07-125199 | A | 5/1995 |
| JP | 2000-177121 | A | 6/2000 |
| JP | 2002-301414 | A | 10/2002 |
| JP | 2005-088294 | A | 4/2005 |
| JP | 2005-153247 | A | 6/2005 |
| JP | 2007-230061 | A | 9/2007 |
| JP | 2008-036930 | A | 2/2008 |
| WO | 90/05066 | A1 | 5/1990 |
| WO | 98/56585 | A1 | 12/1998 |
| WO | 2008/044060 | A1 | 4/2008 |

* cited by examiner

PRINT HEAD FOR AN INK JET PRINTER

CROSS REFERENCE TO RELATED APPLICATIONS

This application is a divisional of and Applicants claim priority under 35 U.S.C. §§120 and 121 of U.S. patent application Ser. No. 14/233,933 filed on Mar. 28, 2014, which application is a national stage application under 35 U.S.C. §371 of PCT Application No. PCT/EP2012/063582 filed on Jul. 11, 2012, which claims priority under 35 U.S.C. §119 from Austrian Patent Application No. A 1081/2011 filed on Jul. 22, 2011, the disclosures of each of which are hereby incorporated by reference. A certified copy of priority Austrian Patent Application No. A 1081/2011 is contained in parent U.S. patent application Ser. No. 14/233,933. The International Application under PCT article 21(2) was not published in English.

BACKGROUND OF THE INVENTION

1. Field of the Invention

The present invention relates to a print head for an ink jet printer, wherein the print head comprises at least one ink supply channel and at least one nozzle with a nozzle channel and inflow opening, wherein ink is pressed out of the ink supply channel through the inflow opening into the nozzle channel and can be ejected from the latter, wherein the nozzle is arranged in a stationary manner on a side wall of the ink supply channel and to the at least one nozzle a ram is assigned with a ram end face in the ink supply channel which is spaced apart from the inflow opening, wherein the print head comprises first means for moving the ram end face in the ink supply channel between a reversal point that has a minimum distance from the inflow opening of the nozzle and a reversal point that has a maximum distance from the inflow opening of the nozzle.

Furthermore, the invention relates to a method for performing printing processes comprising the following steps:

- providing a print head with ink supply channel, ram and nozzle with nozzle channel and inflow opening which forms the connection of the nozzle channel to the ink supply channel,
- filling the ink supply channel with ink.

2. Description of the Related Art

A print head for an ink jet printer, such as the subject matter of the invention, comprises an ink supply channel and at least one nozzle, wherein a movable ram is assigned to the nozzle for causing the ejection of ink from the ink supply channel.

First of all, some of the terms used in this document should be defined: the term "position of rest" is used in the present context to mean that a sealing body adopts a position in the ink supply channel of a print head that is dependent on the printing process, which means that no ink exits from the print head corresponding to printing a substrate.

The term "operating position" is defined in this context to mean that a sealing body adopts a position in the ink supply channel that is dependent on the printing process which enables the printing of a substrate with ink.

The term "means" is defined in this context to mean that according to the context either the singular or plural of the term may be intended.

The term "pigments" is defined in this context to mean particles in the ink with solid body properties that are not soluble.

The term "ink channel" is defined as a synonym for the term "ink supply channel" in this context.

The ink jet printing technique is a widely used printing technique for printing substrates. The print heads of ink jet printing devices generally comprise at least one ink supply channel and at least one nozzle for ejecting ink from the ink supply channel.

In the case of piezo-ink jet printers at least one piezo-element is deformed by applying an electric voltage, such that by means of the deformation a pressure wave is produced in the ink chamber or the ink channel, which causes the ejection of an ink droplet through the nozzle.

A print head of the said kind is known for example from WO 2008/044069 A. In the known device the nozzles, which are in the form of narrow strips with a passage opening for ink, are moved or set into oscillation in order to cause the ejection of a droplet from the nozzle.

In other known print heads, which enable the printing of high viscosity ink, for the ejection of droplets usually the ink is placed under excess pressure and a valve is opened briefly to let a droplet through. Such systems have the disadvantage however that when using inks with large sized pigments problems can occur with the tightness of the valves and it is very difficult to prevent sedimentation in the region of the valve seat.

Conventional print heads, which contain an ink supply channel and at least one nozzle, wherein a sealing body is assigned to each nozzle, comprise means which open a nozzle during the printing process. In the position of rest the nozzle is sealed tightly by the sealing body thereby preventing the ink pressurized with excess pressure from running out of the ink supply channel. In operating position the ram is lifted from the nozzle, so that ink can flow into the nozzle and can be ejected from the ink supply channel.

A print head of this kind is disclosed in document EP 0 445 137 B1. The document describes a print head for an ink jet printer with an ink chamber connected to an ink pressure source, in which a plurality of sealing bodies each closing a nozzle are arranged, which are each connected to a connecting rod and the sealing bodies are moved back and forth by a drive device in the ink chamber. In the position of rest the sealing body seals the ink jet nozzle completely. If the sealing body is moved from the position of rest into an operating position the latter is lifted from the nozzle or withdrawn. The ink is pressurized continuously with excess pressure in the ink chamber, so that only when removing the sealing body can ink be ejected from the ink supply channel through the nozzle. As soon as the sealing body has returned to the position of rest the ink jet nozzle is closed.

A further print head is disclosed in document EP 0 787 587 B1. The document describes a sealing body, which is formed to be T-shaped by a piston with an axially assigned sealing pin. The sealing body is located inside a cylindrical chamber, wherein the external diameter of the cylindrical piston corresponds approximately to the internal diameter of the chamber, so that the piston is moved in a sealing manner back and forth along the chamber wall. The piston separates the chamber into two areas, wherein one area comprises at the bottom a front plate which comprises a nozzle in the form of a borehole for ejecting ink droplets. Said area comprises the ink and forms the ink chamber, which is connected to an ink pressure source. In the other chamber is a spring, which pushes against the sealing body. According to the construction in the position of rest the sealing pin extends into the borehole of the nozzle and seals the latter, whereby an ink film is provided between the front plate and piston. If excess pressure builds up in the ink chamber, the pressure means that against the restoring force of a spring the piston and thus the sealing pin are removed from the borehole from the position of rest into an operating position, after which the ink pressurized by excess pressure flows into the borehole and can be ejected out of the nozzle. If the excess pressure drops the sealing pin is returned to the position of rest and moves back into the borehole, whereby the residual ink in the nozzle is displaced and the borehole is sealed.

Conventional print heads for performing printing processes with a sealing body are designed in their functional and characteristic structure for performing printing processes at relatively low printing frequencies which is reflected by relatively slow printing processes.

When performing a printing step the sealing body is moved from the position of rest into an operating position, wherein the ink pressurized with excess pressure exits from the ink channel through the nozzle. The ink flow is stopped in that the sealing body impinges in the nozzle, on the nozzle or on the inner wall of the ink chamber and tightly seals the inflow opening of the nozzle.

In order to separate an ink droplet cleanly from the residual ink, the sealing body has to close completely or seal the inflow opening of the nozzle, whereby a collision of the sealing body with the nozzle and/or the internal wall of the ink chamber is unavoidable. If the inflow opening of the nozzle in a position of rest is not completely sealed by the sealing body ink can escape continuously in the form of an ink jet out from the ink channel through the nozzle.

The more droplets required per unit of time for producing a desired pattern or structural print pattern, the higher the corresponding printing frequency of the printing steps to be performed.

Of course, the implementation of printing steps with a relatively high printing frequency is limited by periodic collisions of the sealing body with the nozzle and/or the internal wall of the ink chamber, as the collisions in the briefest period can cause the material failure of the sealing body and/or the nozzle which is associated with a short lifetime of the print head.

The stability of the printing process is reduced increasingly in conventional print heads the higher the printing frequency, as the probability of the material failure of the sealing body and/or nozzle increases accordingly.

In other conventional print heads, such as e.g. in document EP 0 787 587 B1, it is possible to avoid a hard collision of a T-shaped sealing body with the nozzle and/or internal wall of the ink chamber at least partly, as an ink film separates at least a section or part of the sealing body from the nozzle. If the sealing body is moved from an operating position into a position of rest, in the position of rest the sealing pin of the sealing body reaches into the channel of the nozzle and seals the latter, wherein however because of the construction and process the ink or ink film no longer displaceable in the ink chamber in a section opposite the end face of the sealing body piston cannot escape radially outwards over the sealing body piston external edge, as the sealing body piston is moved back and forth in a sealing manner on the chamber wall so that a collision of the sealing body with the ink film still occurs. A collision with the ink film is slightly gentler than a collision with a solid body, since as already known a fluid has greater compressibility than a solid body, so that the lifetime can be increased at least partly. However, material failure cannot be excluded but only delayed. In the known embodiment of the print head the following applies, i.e. the greater the printing frequency and thus the collision frequency, the greater the probability of material failure. If the ink contains pigments the failure of the material is even more likely.

SUMMARY OF THE INVENTION

One objective of the invention is to provide a printing method and a printing device which make is possible to perform printing steps at a higher frequency than in conventional printing methods.

Said objective is achieved according to the invention by a printing device of the aforementioned kind in that the first means limit the movement of a ram end face to a movement between the reversal points, and second means are provided for pressurizing the ink in the ink supply channel with negative pressure relative to the environmental air pressure. During the printing method, i.e. at least during time intervals in which printing does not occur or in which no ink needs to be ejected from the ink channel, the ink supply channel is pressurized at least in the region of the inflow opening of the nozzle with a negative pressure relative to the environmental pressure. The negative pressure prevents ink from leaking unintentionally out of the ink channel. In this way it is not necessary to have a sealing body. In order to eject the ink a ram provided in the ink channel is used, the end face of which is moved towards the nozzle channel, whereby ink is pressed through the nozzle channel and out of the latter, whereby preferably during the entire printing process a ram/nozzle spacing is maintained, i.e. a ram end face at one reversal point has a distance from the inflow opening of more than zero and the inflow opening of the nozzle remains permanently open during the entire printing process. The ram according to the invention thus does not perform the function of a sealing body.

By means of the print head according to the invention it is possible to use inks which are within a broad viscosity range and/or contain pigments.

This is the case in particular because the ram does not need to function as a sealing body and does not disrupt the ink and/or pigments pushing between the ram end face and inflow opening of the nozzle channel.

The said inks can be used by the print head according to the invention for structural printing. The term structural printing relates here to the application of three-dimensional forms, lines, structures, etc. on at least one surface with smooth and/or rough areas, e.g. a wooden structure on an MDF/HDF board or extrusion, Braille or simulation of relief printing etc.

Preferably, the nozzle is fixed in a stationary manner on a side wall of the ink supply channel and a ram is provided which is moved back and forth in the ink supply channel between two reversal points opposite the nozzle.

The functional and characteristic structure and printing method of the printing device according to the invention is characterised in particular in that means are provided, preferably external means, which produce negative pressure in the ink supply channel, so that a nozzle can remain open during the whole printing process without ink being able to escape unintentionally. According to a preferred embodiment a ram is moved back and forth between two reversal points (U1) and (U2) opposite the nozzle, wherein the ram/nozzle distance is greater than zero, so that at no point during the printing process, i.e. before and/or during and/or after the ejection of ink are there periodic collisions of the ram with the nozzle. In this way by means of the print head according to the invention it is possible to print at higher printing frequencies than in conventional printing methods.

The ram is arranged in a preferred embodiment not in a sealing manner in the ink supply channel on an ink channel wall, i.e. it does not form a sealing body at any time, wherein for ejecting the ink an end face of the ram is moved from a starting point to the inflow opening. An end face of the ram is only moved up to a first reversal point (U1) to the inflow opening, whereby said first reversal point (U1) is spaced apart from the inflow opening, so that there is no closure of the ink supply channel at the first reversal point (U1). If the ram end side for ejecting the ink is moved from a starting point to the inflow opening, the ink is pressed from a stagnation area between the end face of the ram and the area of the side wall opposite the ram end face with a nozzle in the direction of the inflow opening of the nozzle, whereby at the same ink inside the ink supply channel can flow outwards, i.e. over the ram external edge.

The terms "ram end face" and "end face" have the same meaning in this context. The ram end face is not necessarily a cohesive surface in the invention, but can also comprise two more surfaces.

The printing method according to the invention has shown that the lifetime of the print head is increased, as the ram prevents collisions with the liquid or liquid film below the ram end face and/or the nozzle and/or the internal wall of the ink supply channel.

By means of the invention a greater degree of processing stability is achieved than with a conventional print head, which comprises a ram, as owing to the construction and method the probability of the material failure of the ram and/or nozzle is much reduced.

The print head according to the invention for an ink jet printer comprises at least one ink supply channel and at least one nozzle with a nozzle channel and inflow opening, wherein ink can be pressed through the inflow opening out of the ink supply channel into the nozzle channel and can be ejected from the latter, wherein the nozzle is arranged in a stationary manner on a side wall of the ink supply channel and to the at least one nozzle a ram is assigned with a ram end face lying in the ink supply channel which ram end face is spaced apart from the inflow opening, wherein the print head comprises first means for moving a ram end face in the ink supply channel between a reversal point (U1) that has a minimum distance from the inflow opening of the nozzle and a reversal point (U2) that has a maximum distance from the inflow opening of the nozzle, wherein the first means delimit the movement of a ram end face to a movement between the reversal points (U1,U2) and second means for pressurizing the ink in the ink supply channel with negative pressure relative to the environmental air pressure. A third means can be provided for pumping the ink through the ink supply channel in order to prevent the sedimentation of the ink in the ink supply channel.

The means for moving a ram comprise in a preferred embodiment at least one actuator, wherein the at least one actuator can move the ram between two reversal points. In a different preferred embodiment of the present invention the means for moving a ram can comprise at least one actuator and at least one spring. However, other conventional means can also be used for moving the ram.

The preferably external means for pressurizing the ink in the ink supply channel with negative pressure relative to environmental air pressure can be for example conventional vacuum pumps, by means of which it is possible to generate a corresponding counter pressure to environmental air pressure and the geodetic pressure of ink in the nozzle channel, in order to prevent ink escaping from the ink supply channel.

The ink pressure needs to be adjusted in combination with the capillary pressure so that no air is suctioned through the nozzle channel into the ink supply channel and no ink escapes unintentionally out of the nozzle channel. The ink pressure according to the definition is the sum of the circulation pressure and the meniscus negative pressure.

The external means can be conventional pumps such as e.g. a circulation pump or a recirculation pump. By way of the means the ink is pumped through the ink supply channel, preferably permanently.

In a preferred embodiment of the present invention at the reversal point (U1) that is at a minimum distance the distance between a ram end face and the inflow opening is greater than zero.

In order to ensure the optimum productivity of a print head according to the invention there can be a plurality of nozzles in the ink supply channel, wherein a ram is assigned to each nozzle.

In another preferred embodiment of the invention at least in the case of the at least one nozzle no side wall is formed in one piece together with the nozzle and an end face surrounding the inflow opening of the at least one nozzle is configured to be flush with an inner surface of a side wall of the ink supply channel in contact with the ink.

The aforementioned objective can also be achieved by a method of the aforementioned kind in that the ink in the ink supply channel is pressurized with negative pressure relative to the environmental air pressure at least in the region of the inflow opening of the nozzle, at least during the time intervals in which printing does not occur, whereby the flow of ink out of the nozzle channel is prevented even without a sealing body and for ejecting the ink an end face of the ram is moved from a starting point to the inflow opening.

The printing method according to the invention for performing printing processes comprises several steps, wherein in a first step a print head is provided with an ink supply channel, rain and nozzle with nozzle channel and inflow opening, which forms the connection of the nozzle channel to the ink supply channel, and in a second step the ink supply channel is filled with ink, wherein the ink is pressurized with negative pressure at least in the region of the inflow opening of the nozzle, at least during the time intervals in which printing does not occur, whereby the flow of ink out of the nozzle channel is also prevented without a sealing body and wherein for ejecting the ink an end face of the ram is moved from a starting point to the inflow opening.

In the printing method in a preferred embodiment an end face of the ram is moved towards the inflow opening only up to a first reversal point (U1), whereby said first reversal point (U1) is spaced apart from the inflow opening so that at the first reversal point (U1) there is no closure of the ink supply channel.

After reaching reversal point (U1) the end face of the rain is moved away from the inflow opening to a second reversal point (U2) which forms the starting point for the following printing cycle.

The position starting point and the following reversal point (U1) is selected so that the ram stroke ejects a predetermined amount of ink and thereby droplet size.

In a preferred embodiment in the printing method in an operating step in which the ram end face is moved for ejecting the ink from a starting point to the inflow opening, the ink is pressed from a stagnation area between the end face of the ram and the area of the side wall opposite the ram end face with nozzle in the direction of the inflow opening of the nozzle, wherein at the same time ink can flow outwards inside the ink supply channel i.e. can flow out over the ram outer edge, whereby in said preferred printing method the distance of the ram outer edge to a side wall of the ink supply channel in a direction vertical to the nozzle axis has to be greater than zero. Because of the movement of the ram there is continuously a relatively heavy flow of ink in the region of the inflow opening of the nozzle, so that it is possible to prevent sedimentation of the ink very efficiently in this area.

If the end face of the ram is moved from a starting point to the inflow opening, there is a change of volume and pressure in the area close to the nozzle, which causes the ejection of ink from the ink supply channel.

The ink is pumped through the ink supply channel, preferably continuously, in the method according to the invention.

A stagnation area is the area between the ram end face and the area of the side wall with nozzle opposite the ram end face. In this stagnation area as a result of the movement of the ram, which is moved from a starting point towards the inflow opening of the nozzle, the ink is under the highest pressure, so that the ink is pressed from said stagnation area in the direction of the inflow opening of the nozzle, whereby at the same time ink can flow out inside the ink supply channel, i.e. over the ram outer edge. If according to a preferred embodiment of the invention the ram is configured to be cylindrical and the nozzle as well, the stagnation area is ideally referred to for simplicity as the stagnation radius.

In the printing method according to the invention the nozzle remains open during the entire printing process, so that the ram does not close the inflow opening of the nozzle and does not touch the nozzle and/or the inner wall of the ink supply channel.

In the printing method in step (a) the ram end face is moved by means from a reversal point (U2) opposite the inflow opening of the nozzle in a stroke movement in the direction of the inflow opening of the nozzle to a reversal point (U1) opposite the nozzle, whereby a change in volume and pressure occurs in the area close to the nozzle which causes an ejection of ink from the nozzle. In step (b) the ram end face is moved by means from a reversal point (U1) in a stroke movement in opposite direction of the inflow opening of the nozzle to a reversal point (U2), whereby steps (a) and (b) are performed one after the other and the reversal point (U2) forms the starting point of the following printing cycle, whereby during the whole printing process the ram/nozzle distance is greater than zero. The reversal point (U1) always has a smaller nozzle/ram distance than reversal point (U2).

In particular it should be noted that the printing method with the printing device is a DOD-printing technique (Drop-on-demand) in which ink droplets are only ejected from a nozzle when they are actually needed.

Any sedimentation of ink in the ink channel and at the nozzles is prevented as the print head of the invention according to a preferred embodiment comprises external means for pumping the ink through the ink channel which pump the ink through the ink supply channel, preferably continuously.

The printing method according to the invention for performing printing processes with the print head is characterised in a preferred embodiment in that the ram is moved in the ink supply channel between two reversal points opposite the inflow opening of the nozzle, reversal point (U1) and reversal point (U2), whereby preferably at no time during the printing, i.e. before and/or during and/or after ejecting ink does the ram contact or close the nozzle and/or a side wall of the ink supply channel.

The solution according to the invention enables in a simple manner a mechanically very stable arrangement of the nozzles and the very efficient prevention of ink sedimentation even when using inks with large size pigments. It should be noted at this point that the term stationary in this context is defined to mean that the position of the nozzle during operation does not change relative to the ink channel. However, for maintenance and replacement purposes the nozzle can be removed from the ink channel and the nozzle can be screwed into the ink channel for example. Furthermore, by using a ram cooperating with the nozzle it is possible to avoid the arrangement of a valve which is opened after generating excess pressure in the ink channel.

Any sedimentation at the nozzles can be also prevented very effectively in that an end face of the nozzle comprising the inflow opening is configured to be flush with an inner surface of the side wall of the ink supply channel in contact with the ink.

The ejection of ink and self-cleaning of the nozzle are facilitated in that a longitudinal middle axis of the at least one nozzle runs normally to the surface of the ink supply channel.

In a particularly preferred embodiment of the invention the inflow opening of the nozzle is arranged in an area of the side wall opposite the rain, which is delimited by a cylindrical delimiting face formed during the movement of the ram in the ink. Said embodiment of the invention is characterised in that a pump chamber can be formed, i.e. the area in which there is change of volume during the ejection or suctioning of the ink, in which only the two cover faces (end face of the ram and end face of the nozzle) are configured as solid bodies and the casing surfaces are formed by the ink fluid. In this way sedimentation and the agglomeration of ink in the pump chamber and maintenance can be considerably reduced.

According to an advantageous development of the invention it is possible that a section of the ram opposite the end face is connected securely to a movable ram rod, which is pressurized by a restoring force acting in the direction of the nozzle. By means of this embodiment of the invention a movement of the ram in the direction of the nozzle can be triggered in a simple way for ejecting ink. The restoring force can be provided for example by a helical spring, which is compressed when withdrawing the ram from the nozzle. The force required to withdraw the ram can be produced by means such as an actuator, for example an electromechanical actuator, in particular an electromagnet, a pneumatic or other suitable actuator. For this purpose the ram rod can be connected to the actuator, which produces a force acting against the restoring force. When using an electromechanical actuator in a currentless state of the actuator the ram can be moved by the spring against the nozzle. Of course, it is also possible in the embodiment just described for the spring and actuator to be changed over. The use of a second actuator would also be possible instead of the spring.

According to one variant of the invention it is possible for the ram rod to be guided movably at least in part in a hollow shaft parallel to a longitudinal middle straight line of the hollow shaft, whereby between the guide rod and the hollow shaft a radially peripheral seal can be provided. By means of this embodiment of the invention the flow resistance in the ink channel can be reduced considerably as the hollow shaft, which is also denoted in the following as a guide shaft, can be configured to be very slim without worsening the guide function for the ram rod. By means of the seal between the ram rod and guide shaft the penetration of ink into the guide shaft can be prevented.

In order to reduce the flow resistance in the nozzle and increase its effectiveness, the inflow opening of the nozzle can be configured to be conical, in the form of a funnel that tapers in the direction of an outflow opening. In a particularly advantageous development of this embodiment the outflow opening of the nozzle is designed to be cylindrical.

To prevent the complete emptying of the nozzle during the suctioning of ink caused by a stroke movement of the ram and the penetration of air into the pump chamber, the nozzle can have a length in flow direction which is a multiple, but at least twice a maximum diameter of the nozzle.

The lifetime of the nozzle and the ram can be increased in that the nozzle is made of ceramic, hard metal or surface-treated steel and/or the end face of the ram is made at least in part of ceramic, hard metal or surface-treated steel.

BRIEF DESCRIPTION OF THE DRAWINGS

The invention and further advantages are explained in more detail with reference to several non-restrictive exemplary embodiments which are represented in the drawings.

In the latter in a much simplified schematic representation.

DETAILED DESCRIPTION OF PREFERRED EMBODIMENTS

Figure 1:
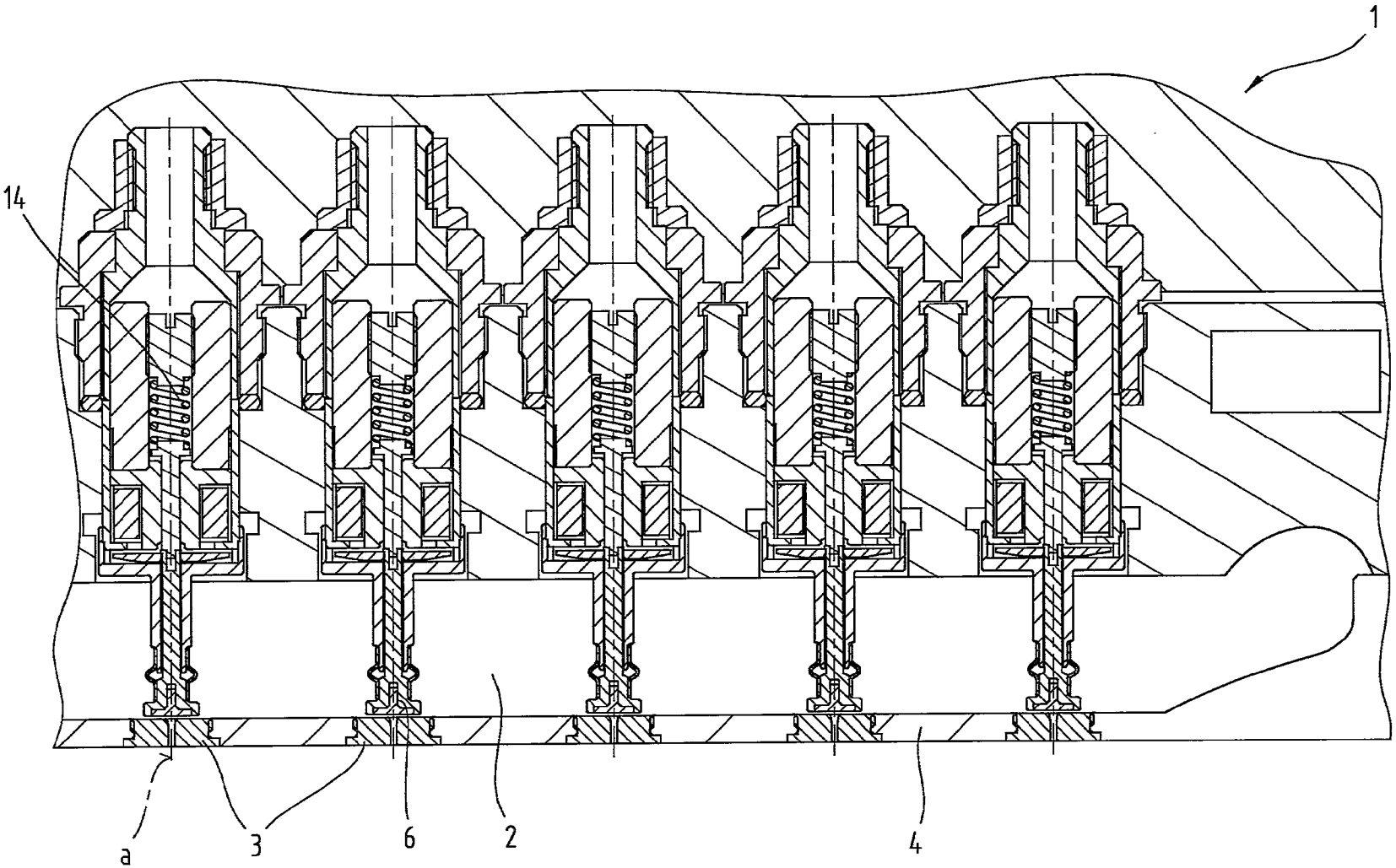
FIG. 1 shows a partial cross section of a print head.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

The Figures are described in general in the following.

Figure 2:
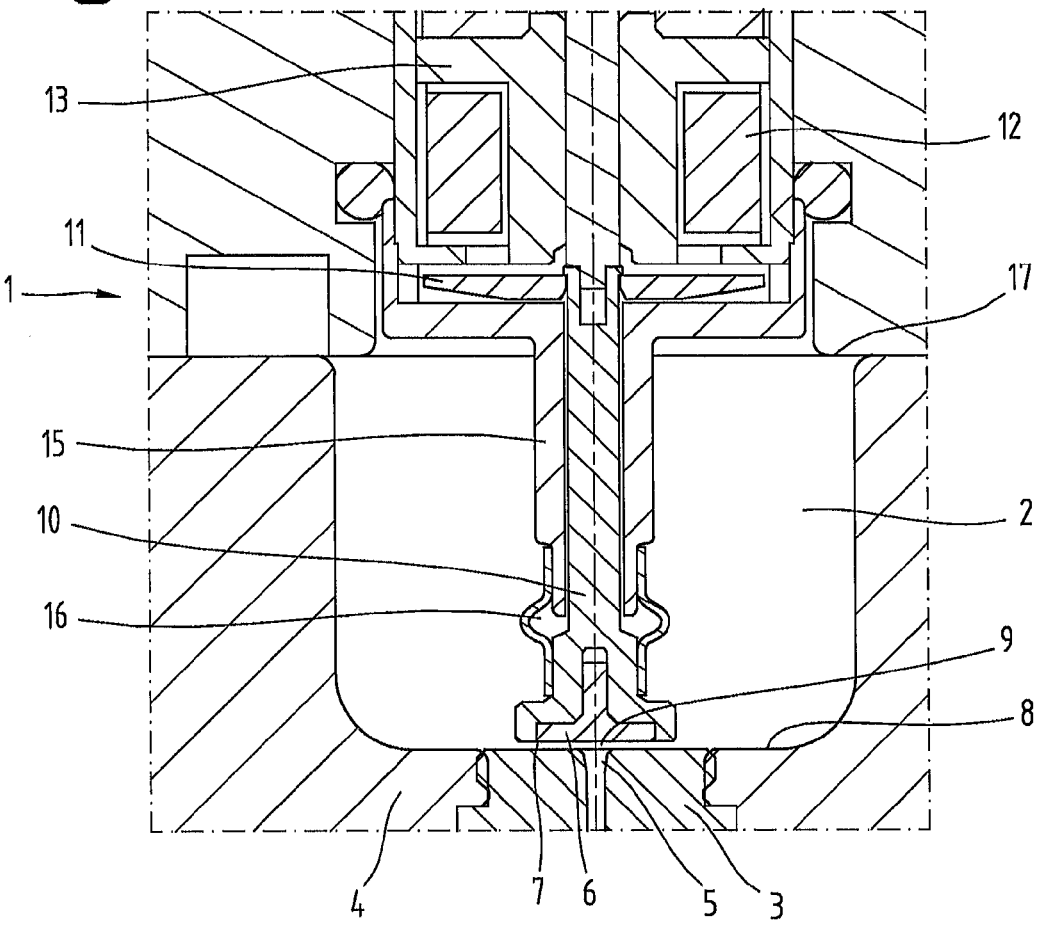
FIG. 2 shows a portion of the print head of FIG. 1 in more detail.

According to FIG. 1 and FIG. 2 a print head 1 for an ink jet printer according to the invention comprises at least one ink supply channel 2 and at least one nozzle 3 for ejecting the ink from the ink supply channel 2.

In the print head 1 a plurality of ink channels can be provided arranged parallel to one another and extended in length, in which, as shown in FIG. 1, nozzles 3 and movable rams 6 are arranged at regular intervals. The ink channels, nozzles 3 and ram 6 are configured or arranged in this case like the ink channel 2, nozzle 3 and ram 6 described in the following. The ink channel 2 is used for supplying ink to the nozzle 3.

The ink can flow continually through the ink channel 2 in order to avoid sedimentation of the ink. The drop in pressure in the ink channel 2 is preferably very small, which can be achieved by having a cross section of the ink channel that is as large as possible.

The nozzle 3 is arranged in a stationary manner on a side wall 4 of the ink supply channel 2 and in the ink supply channel 2 a ram 6 is provided which moves back and forth between two reversal points opposite the inflow opening of the nozzle, reversal point (U1) and reversal point (U2). The nozzle 3 can be arranged replaceably on the side wall 4, for example the nozzle 3 can be screwed into the side wall 4 of the ink supply channel 2. In order resist abrasive pigments in the ink, the nozzle 3 can be made of ceramic, hard metal or glass etc.

An end face 7 of the nozzle 3 comprising the inflow opening 5 can be formed to be flush with an inner surface 8 of the side wall 4 of the ink supply channel 2 in contact with the ink. By means of the flush arrangement of the nozzles 3 on their inner end faces 7 with the inner wall of the ink channel 2 the ink flow is disrupted as little as possible and sedimentation is avoided. A longitudinal middle axis a of the nozzle 3 can in this case run normally to the surface 8 of the ink supply channel 2.

A section of the ram 6 opposite an end face 9 of the ram 6 can be connected securely to a movable ram rod 10 pressurized with a restoring force acting in the direction of the nozzle 3. The ram 6 can be withdrawn from the nozzle by means of an actuator. An electronic actuator can be provided as the actuator for operating the ram, which is for example in the form of a solenoid armature 11 connected to the ram rod 10, which works with a coil 12 which can be wound around a core 13. The ram 6 can be drawn upwards by the armature 11 of the magnet. In this case a spring denoted in FIG. 1 by the reference number 14 is tensioned, which in a currentless state of the actuator pushes the ram 6 back down. When the ram 6 approaches the nozzle 3 or when the solenoid armature 11 approaches the core 13, strong damping occurs caused by the radial film flow and prevents the hard slamming of the ram 6 or the solenoid armature 11 on the ink or ink film between the ram and the nozzle or the inner wall of the ink supply channel and thus increases the lifetime of the rain 6 and the actuator. Instead of the magnet other kinds of drive are also possible for the ram, for example in the form of a compressed air or piezo-actuator.

The ram rod 10 can be guided movably at least in part in a hollow shaft 15 parallel to a longitudinal middle straight line of the guide shaft or hollow shaft 15, wherein a radially peripheral seal 16 can be provided between the guide rod 10 and the hollow shaft 15.

As shown in FIGS. 1 and 2 the guide shaft 15 can protrude from the delimiting wall 17 of the ink channel 2 opposite the nozzle 3 into the ink channel 2. By sealing the transition between the guide shaft 15 and the ram 6 it is possible to prevent the ink penetrating into the guide shaft 15. The guide shaft 15 can be configured to be slim, in order to create as little flow resistance as possible in the ink channel. It is particularly advantageous in this case if the guide shaft or hollow shaft 15 has smooth and/or rounded surface. The guide shaft or hollow shaft 15 can have a circular, elliptical or similar cross section for example.

A ceramic part or part made from a different material than that of the ram can be inserted into the ram end face 9, in order to increase the lifetime of the end face 9 in the presence of abrasive pigments.

Figure 3:
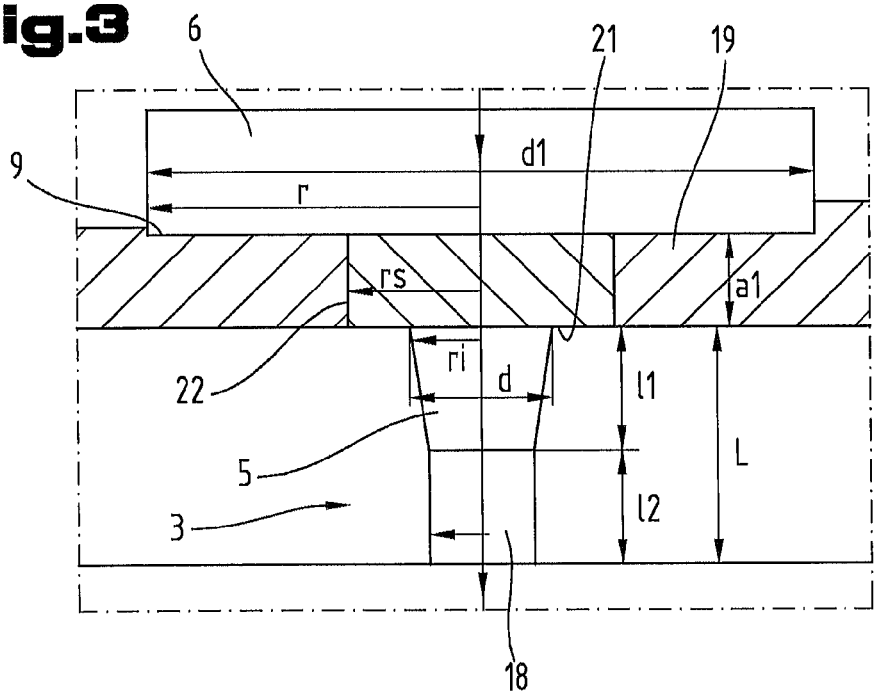
FIG. 3 shows a pump chamber formed between an end face of a ram and a nozzle.

As shown in FIG. 3, the inflow opening 5 of the nozzle 3 can be configured to be conical, in the form of funnel that tapers in the direction of an outlet opening 18. The outlet opening 18 of the nozzle 3 can be configured to be cylindrical. Furthermore, the nozzle 3 can have a length L which is multiple, but at least twice the maximum diameter d of the nozzle 3.

Preferably, the inflow opening 5 of the nozzle 3 is arranged in an area of the side wall 4 opposite the ram 6, which lies inside a pump chamber 19 and delimits the latter in one direction.

The pump effect provided and required for each ink jet-print head is illustrated by an imaginary pump chamber 19 and can be formed by a cylindrical area which is delimited by the diameter dl of the ram end face 9 and the distance al ram-end face to the inner nozzle end face or to the end face of the inflow opening 5. Said space need not necessarily be cylindrical however.

Figure 4:
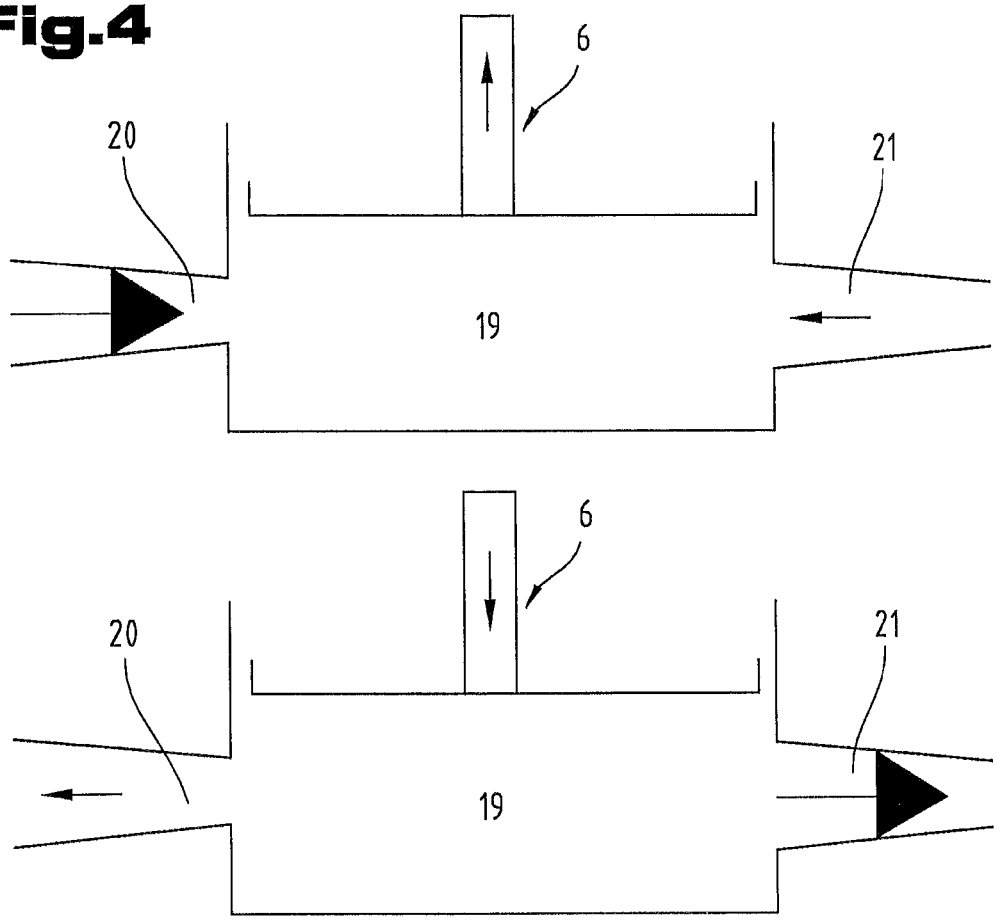
FIG. 4 shows the principle of functioning of an imaginary pump chamber.

The pump chamber 19 is the space in which a change in volume occurs. The pump chamber 19 always has two openings 20 and 21, as shown in FIG. 4 which illustrates the principle of action of a pump chamber, one for the inflow and one for the outflow. During the refill cycle the ram 6 moves upwards and ink flows through the inflow 20 and outflow opening 21 into the space of the pump chamber 19. During the ejection cycle the ram 6 moves downwards and ink flows through the inflow 20 and outflow opening 21 out of the space of the pump chamber 19.

In order that that the print head 1 can eject a droplet more ink needs to flow out through the outflow opening 21 of the pump chamber than flows back through the inflow opening of the pump chamber 19 into the ink channel 2. For suctioning ink into the pump chamber 19 the opposite is true. FIG. 4 illustrates this graphically, the direction of movement of the ram 6 and the flow directions of ink when suctioning in or ejecting ink from the pump chamber 19 being indicated by arrows in FIG. 4. The different arrow thicknesses show the different amounts of inflowing or outflowing ink.

When the ram 6 moves ink is displaced or suctioned in from the pump chamber 19. The ram movement causes at the same time a change in volume and pressure in the pump chamber 19. In this case, as shown in FIG. 5, a pressure gradient is formed along the ram radius r.

Where said pressure gradient is at a maximum or minimum, according to FIG. 3 a cylindrical delimiting face 22 is formed with the so-called stagnation radius rs. Outside said delimiting face 22 the ink flows into or out of the ink channel, inside said delimiting face 22 the ink flows out of the nozzle or into nozzle, depending on the movement direction of the ram 6. The stagnation radius rs is dependent on the movement direction and speed of the ram 6, on the distance al of the rain 6 to the nozzle and on the pressure at radius r and radius ri. As a result volumes of ink flowing in both directions are formed during the back and forth movement of the ram 6.

The inflow opening 5 of the nozzle 3 can be arranged directly at the outflow opening 21 of the pump chamber 19. In this embodiment the inflow opening 5 of the nozzle 3 is arranged in a section of the side wall 4 opposite the ram 6, which during the movement of the ram 6 is delimited by the delimiting face 22 forming by the associated pressure gradient in the ink.

Figure 5:
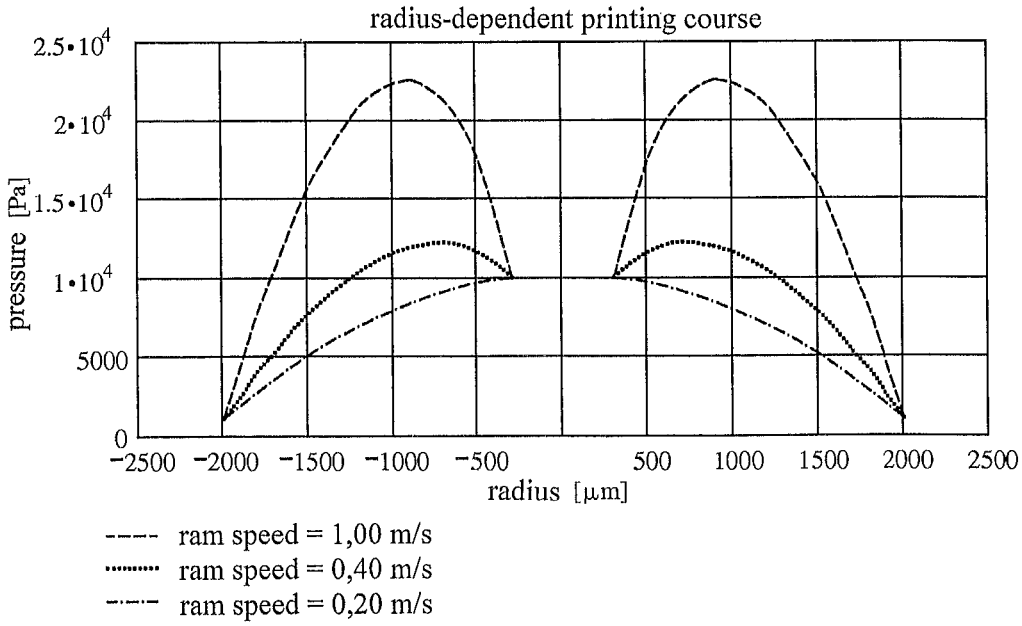
FIG. 5 shows a theoretically calculated print distribution under the end face of a ram.

FIG. 5 shows a theoretically calculated radius-dependent pressure gradient under the ram 6. The stagnation radius rs is located where the pressure has the maximum value.

In commercially available ink jet print heads the length L in flow direction is usually such that the ink volume in the nozzle corresponds approximately to the droplet volume. As the nozzle diameter in a print head for structural printers has to be greater than in commercially available ink jet print heads in order to achieve the required droplet volume, the capillary pressure is substantially smaller and during the refill cycle more ink is suctioned back through the nozzle 3 into the pump chamber 19. For this reason the length of the nozzle L can be substantially increased so that the nozzle cannot be completely emptied during the refill cycle and air cannot enter into the pump chamber 19.

The length L of the nozzle consists of the lengths for the cylindrical part 12 and for the conical part 11. Lastly, as a point of formality it should be noted that for a better understanding of the structure of device according to the invention the latter and its components have not been represented true to scale in part and/or have been enlarged and/or reduced in size.

Finally, as a point of formality, it should be noted that for a better understanding of the structure of the device according to the invention the latter and its components have not been represented true to scale in part and/or have been enlarged and/or reduced in size.

In a preferred embodiment of the present invention a plurality of ink supply channels 2 in a print head are aligned parallel to one another according to length, in which a plurality of nozzles 3 with nozzle channel and inflow opening 5 are preferably arranged at equal distances from one another on the ink supply channel wall. First means 23, such as at least one actuator or at least one actuator and at least one spring are provided for the movement of a ram end face 9 or the ram 6, which delimit the ram end face 9 to a movement between the reversal points (U1, U2). A second external means, such as a vacuum pump, which is arranged e.g. in an ink intermediate tank that is connected by at least one ink supply line to the print head and which pump is arranged in the airspace above a fluid level, is provided for pressurizing the ink in the ink supply channel 2 with negative pressure relative to the environmental air pressure. A third external means, such as a circulating pump is provided e.g. in an ink intermediate tank, which pumps the ink preferably continuously through the at least one ink supply line and ink supply channels of the print head.

In a preferred embodiment of the printing method the ink in the ink supply channel 2 is pressurized by negative pressure in the region of more than zero to preferably 5 mbar relative to the environmental air pressure with a nozzle internal diameter at the outflow opening of the nozzle of 300 μm. For example, other negative pressures can be used however, wherein the ink pressure may not be less than the capillary pressure to ensure that no air is suctioned through the nozzle into the ink supply channel. To clarify: "negative pressure in the region of more than zero to preferably 5 mbar relative to the environmental air pressure" means a pressure which in the region of more than zero to 5 mbar is lower than the environmental air pressure.

The ink output pumped through the ink supply channel per time unit "X" is in a preferred embodiment greater by a specific factor adapted to the system than the sum of the amount of ink that can be ejected at the maximum through all nozzles during the printing operation, whereby the rule is that the ink pressure has to be adapted in combination with the capillary pressure so that no air is suctioned through the nozzle channel into the ink supply channel and no ink exits unintentionally out of the nozzle channel.

The rain 6 is not arranged in a sealing manner in the ink supply channel 2 on an ink channel wall, whereby a distance of the ram outer edge to a side wall of the ink supply channel in a direction vertical to the nozzle axis is preferably greater than 1 mm and more preferably greater than 3 mm.

In a preferred embodiment of the print head device the rain 6 has an external diameter of preferably between 3.0 to 5.0 mm. The nozzle 3 in this case has an internal diameter of preferably between 200 to 350 μm.

In a preferred embodiment of the printing method the change in direction at reversal point (U1) has a frequency of preferably up to 1.1 kHz and more preferably up to 1.0 kHz. If the ram external diameter is selected to be smaller it is possible to print at much higher frequencies.

In the printing method the ram/nozzle distance at reversal point (U1) is maintained to be greater than zero and preferably up to 100 μm and the ram/nozzle distance at reversal point (U2) is greater than 250 μm and preferably up to 400 μm.

The method can be used for printing inks of varying viscosity, wherein preferably the ink has a viscosity η of η=50-100 mPa·sec and/or the ink for printing comprises pigments with a pigment size of up to 10 μm, wherein the ink has a pigment size of preferably up to 5 μm Inks with a low or higher viscosity than said viscosity η of η=50-100 mPa·sec and/or with larger pigment sizes than 10 μm can also be used in principle, as long as an optimal printing stability can be ensured.

If inks are used in the printing process with pigments, which have a particle size "g", of course at least a ram/nozzle distance should be selected at a reversal point that is at least greater than the corresponding particle size "g" in order to avoid collisions of the ram with pigments that may be present on the nozzle surface.

If the ram end face 9 moves from a starting point towards the inflow opening there is a change in volume and pressure in an area of the inflow opening of the nozzle and a specific amount of ink and thus droplet size is ejected from the nozzle. A main droplet is ejected from the nozzle, but depending on the printing method together with the main droplets more or less undesirable small droplets, so-called satellites, are ejected with the main droplets.

In other embodiments of the present invention a plurality of print heads can be mounted in a staggered or any other arrangement and thereby can be arranged such that in the printing process at least one nozzle of a print head overlaps with at least one nozzle of another print head in at least one direction and/or that the nozzles of a row of nozzles of a print head are displaced relative to the nozzles of a row of nozzles of another print head by a specific nozzle distance.

If the nozzles are displaced relative to one another greater droplet densities and thereby higher image resolutions can be achieved.

In a further embodiment of the present invention, in which the print heads are moved in a secondary scanning direction Y and main printing direction X in the printing process, the rows of nozzles of the print heads can be adjusted parallel to one another and obliquely at an angle relative to a secondary scanning direction Y, so that the nozzle distance between the individual nozzles of a print head in a main printing direction X has a nozzle spacing Y, so that printing is possible in the main scanning direction X with a higher resolution than the native resolution of a print head.

The present invention is not intended to be restricted to the embodiments of the print head device given by way of example and in the drawings.

LIST OF REFERENCE NUMERALS

1 print head
2 ink supply channel
3 nozzle
4 side wall
5 inflow opening
6 ram
7 end face of nozzle
8 surface
9 ram end face or end side
10 ram rod
11 solenoid armature
12 coil
13 core
14 spring
15 hollow shaft
16 seal
17 delimiting wall
18 outlet opening of the nozzle
19 pump chamber
20 inflow opening
21 outflow opening
22 delimiting face

What is claimed is:

1. A print head for an ink jet printer, the print head comprising at least one ink supply channel, an ink with pigments, and at least one nozzle with a nozzle channel and inflow opening, the ink being pressed through the inflow opening from the ink supply channel into the nozzle channel and ejected from the latter, the nozzle being arranged in a stationary manner on a side wall of the ink supply channel and a ram is assigned to the at least one nozzle with a ram end face in the ink supply channel which ram end face is spaced apart opposite the inflow opening, the print head comprising a first moving device for moving the ram end face in the ink supply channel between a first reversal point that has a minimum distance from the inflow opening of the nozzle and a second reversal point that has a maximum distance from the inflow opening of the nozzle, wherein the first moving device delimits the movement of the ram end face to a movement between the first and second reversal points, wherein at said first reversal point said minimum distance is greater than a particle size of the pigments of the ink, wherein a pressurizer is provided for pressurizing the ink in the ink supply channel with a negative pressure relative to the environmental air pressure, and wherein a circulating pump is provided for pumping said ink through said ink supply channel of the print head.

2. The print head as claimed in claim 1, wherein a distance of a ram outer edge to a side wall of the ink supply channel in a direction vertical to the nozzle axis is greater than zero.

3. The print head as claimed in claim 1, further comprising a plurality of nozzles and a respective ram assigned to each nozzle.

4. The print head as claimed in claim 1, wherein at least in the case of the at least one nozzle no side wall is configured in one piece with the nozzle and an end face of the at least one nozzle surrounding the inflow opening is formed flush with an inner surface of a side wall of the ink supply channel that is in contact with the ink.

5. The print head as claimed in claim 1, wherein a longitudinal middle axis of the at least one nozzle extends normally to the surface of the ink supply channel.

6. The print head as claimed in claim 1, wherein the inflow opening of the nozzle is arranged in a section of the side wall opposite the ram, which side wall is delimited by a cylindrical delimiting face forming with the movement of the ram in the ink.

7. The print head as claimed in claim 6, wherein a section of the ram opposite the end face of the ram is connected securely with a movable ram rod pressurized by a restoring force acting in the direction of the nozzle.

8. The print head as claimed in claim 7, wherein the ram rod is guided movably at least in part in a hollow shaft parallel to a longitudinal middle straight line of the hollow shaft, wherein a radially peripheral seal is provided between the guide rod and the hollow shaft.

9. The print head as claimed in claim 1, wherein the inflow opening of the nozzle is conical, in the form of a funnel that tapers in the direction of an outlet opening.

10. The print head as claimed in claim 1, wherein the outlet opening of the nozzle is designed to be cylindrical.

11. The print head as claimed in claim 1, wherein the nozzle has a length which is a multiple but at least twice the maximum diameter of the nozzle.

12. The print head as claimed in claim 1, wherein the nozzle is of ceramic, hard metal or surface-treated steel and/or the end face of the ram is made at least in part of ceramic, hard metal or surface-treated steel.

13. The print head as claimed in claim 1, wherein the ram has an external diameter of between 3.0 to 5.0 mm.

14. The print head as claimed in claim 1, wherein a nozzle has an internal diameter of between 200 to 350 μm.

15. A method for performing printing processes comprising the following steps:

providing a print head with an ink supply channel, a ram and a nozzle with a nozzle channel and an inflow opening which forms the connection of the nozzle channel to the ink supply channel, filling the ink supply channel with an ink, wherein the ink is pressurized, at least during the time intervals in which printing does not occur, in the ink supply channel at least in the region of the inflow opening of the nozzle with a negative pressure relative to the environmental air pressure, whereby the flow of ink out of the nozzle channel is prevented even without a sealing body, ejecting a droplet of said ink through the nozzle by moving an end face of the ram from a starting point to the inflow opening, wherein the end face of the ram is only moved up to a first reversal point towards the inflow opening, wherein at said first reversal point said end face is spaced apart from the inflow opening a minimum distance so that at the first reversal point there is no closure of the ink supply channel, said minimum distance at said first reversal point being greater than a particle size of pigments of said ink, and pumping said ink through said ink supply channel via a circulating pump.

16. The method as claimed in claim 15, wherein after reaching the first reversal point the end face of the ram is moved away from the inflow opening to a second reversal point, which forms the starting point for the generation of a subsequent droplet of ink.

17. The method as claimed in claim 16, wherein the position of the starting point and the following first reversal point is selected so that the ram stroke ejects a predefined amount of ink and thereby droplet size.

18. The method as claimed in claim 15, wherein in the step where the ram end face for ejecting the ink is moved from a starting point towards the inflow opening, the ink is pressed from a stagnation area between the end face of the ram and the area of the side wall with nozzle opposite the ram end face, in the direction of the inflow opening of the nozzle, whereby at the same time ink inside the ink supply channel can flow outwards over the ram outer edge.

19. The method as claimed in claim 15, wherein the ink is continuously pumped through the ink supply channel.

20. The method as claimed in claim 15, wherein a change in direction of the ram at the first reversal point has a frequency of up to 1.1 kHz.

21. The method as claimed in claim 15, wherein the ram/nozzle distance at the first reversal point is maintained as up to 100 μm.

22. The method as claimed in claim 15, wherein the ram/nozzle distance at the second reversal point is greater than 250 μm.

23. The method as claimed in claim 15, wherein printing with inks of varying viscosity is performed, and wherein the viscosity $\eta$ is from $\eta$=50-100 mPa·sec and/or the inks have a pigment size of up to 10 μm.

24. The method as claimed in claim 15, wherein via the print head three-dimensional forms, lines and structures are applied onto at least one surface with smooth and/or rough areas.

* * * * *